US009706820B1

(12) United States Patent
Lopez

(10) Patent No.: US 9,706,820 B1
(45) Date of Patent: Jul. 18, 2017

(54) UMBRELLA STORAGE SPIKE

(71) Applicant: Onel Lopez, Hialeah, FL (US)

(72) Inventor: Onel Lopez, Hialeah, FL (US)

( * ) Notice: Subject to any disclaimer, the term of this patent is extended or adjusted under 35 U.S.C. 154(b) by 0 days.

(21) Appl. No.: 15/262,196

(22) Filed: Sep. 12, 2016

(51) Int. Cl.
*A45B 23/00* (2006.01)

(52) U.S. Cl.
CPC ..... *A45B 23/00* (2013.01); *A45B 2023/0012* (2013.01); *A45B 2200/1054* (2013.01); *A45B 2200/1063* (2013.01)

(58) Field of Classification Search
CPC .... A45B 2200/1054; A45B 2200/1063; A45B 2200/1009
See application file for complete search history.

(56) References Cited

U.S. PATENT DOCUMENTS 3,710,736 A * 1/1973 Biondi ..... A47B 61/00 109/50
5,143,108 A * 9/1992 Kenney ..... A45B 3/00 108/151
5,199,361 A * 4/1993 Robinson ..... E05G 1/005 109/50
5,979,793 A * 11/1999 Louis ..... A45B 3/00 135/16
6,554,012 B2 * 4/2003 Patarra ..... A45B 3/00 135/16
7,980,185 B1 * 7/2011 Teague, Jr. ..... E05G 1/02 109/50
2005/0161067 A1 * 7/2005 Hollins ..... A45B 23/00 135/16
2015/0083172 A1 * 3/2015 Boal ..... A45B 11/00 135/16
2015/0090307 A1 * 4/2015 Supino ..... A45B 3/00 135/15.1
2016/0119699 A1 * 4/2016 Caban ..... H04R 1/025 381/120

FOREIGN PATENT DOCUMENTS

DE EP 3072414 A1 * 9/2016 ..... A47B 37/04
FR 2945566 A1 * 11/2010 ..... A45B 23/00

* cited by examiner

*Primary Examiner* — David R Dunn
*Assistant Examiner* — Danielle Jackson
(74) *Attorney, Agent, or Firm* — Christopher J. VanDam, PA; Chris Vandam

(57) ABSTRACT

An umbrella storage spike having an upper assembly and a lower assembly, each having a storage space inside. The lower assembly includes external threads to aid in ground penetration for anchoring the device. The top of the upper assembly terminates in a cap that attaches to a pole that supports a canopy. The cap includes a speaker and a charging port used with a portable electronic device.

7 Claims, 2 Drawing Sheets

UMBRELLA STORAGE SPIKE

BACKGROUND OF THE INVENTION

1. Field of the Invention

The present invention relates to portable beach-type umbrellas, and more particularly, to an umbrella with enhanced storage in the ground attachment spike and extended shade capability.

2. Description of the Related Art

Several designs for portable umbrella attachment systems have been designed in the past. None of them, however, includes a lower, below grade compartment for secure storage compartmentalized apart from an upper, above grade storage apparatus in addition to audio entertainment features.

Other patents describing related subject matter and commercially available umbrella support devices provide for a number of more or less complicated features that fail to solve the problem in an efficient and economical way. None of these patents suggest the novel features of the present invention.

SUMMARY OF THE INVENTION

It is one of the main objects of the present invention to provide a portable umbrella with secure storage.

It is another object of this invention to provide an umbrella with accessible storage to keep objects contained therein safe and clean while in a harsh environment.

It is still another object of the present invention to provide an umbrella support that can be ground penetrating or supported by a broad base.

Another object of the present invention is to provide an umbrella support that is capable of charging a portable electronic device and has available an audio speaker to enhance the sound output of a connected audio source.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention is comprised of the details of construction and the combination of parts as will be more fully understood from the following description, when read in conjunction with the accompanying drawings in which.

DETAILED DESCRIPTION OF THE PREFERRED EMBODIMENT

Figure 1:
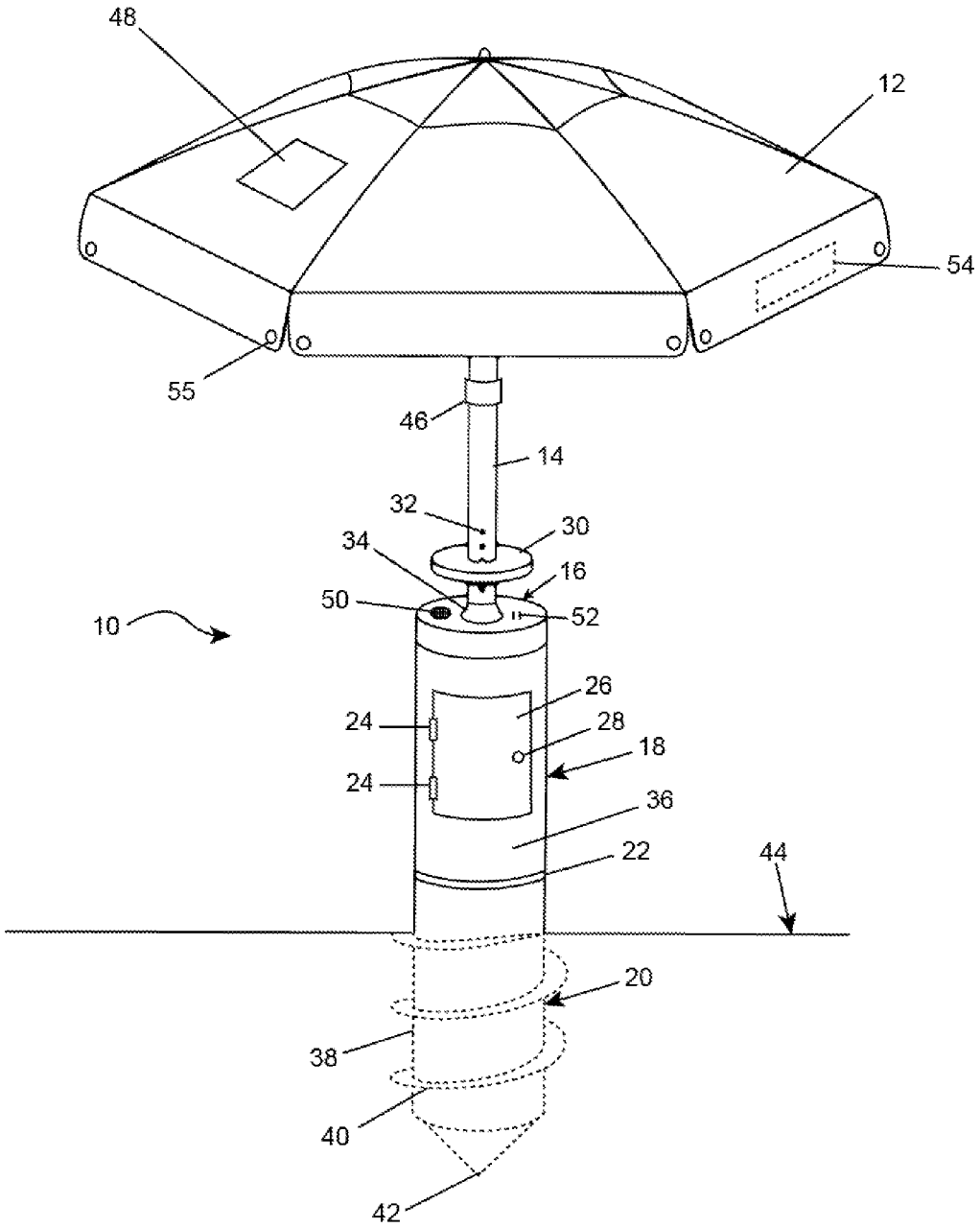
FIG. 1 shows a perspective view of an umbrella with an umbrella storage spike.
Figure 2:
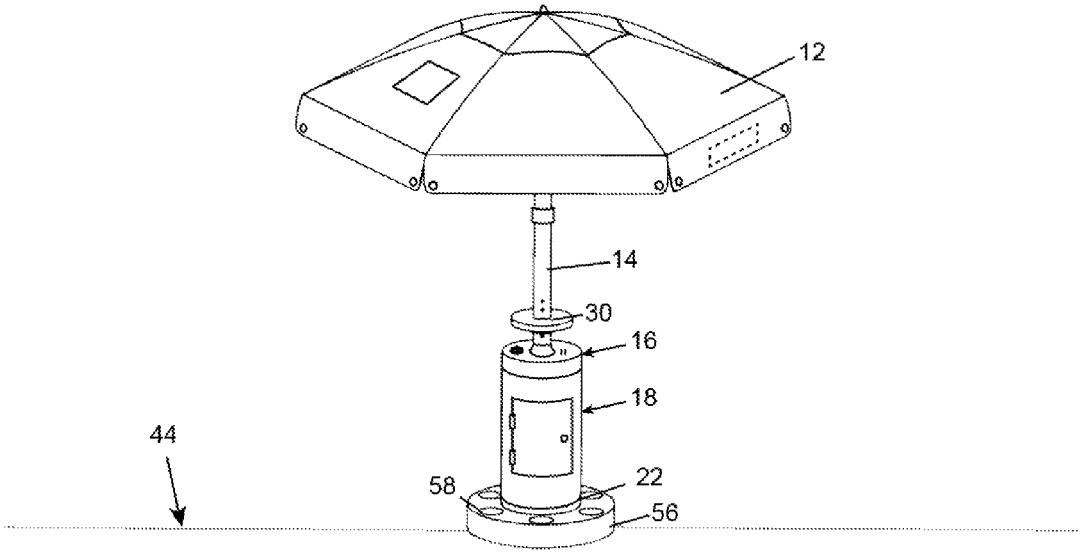
FIG. 2 shows a perspective view of an umbrella storage spike with optional features.
Figure 3:
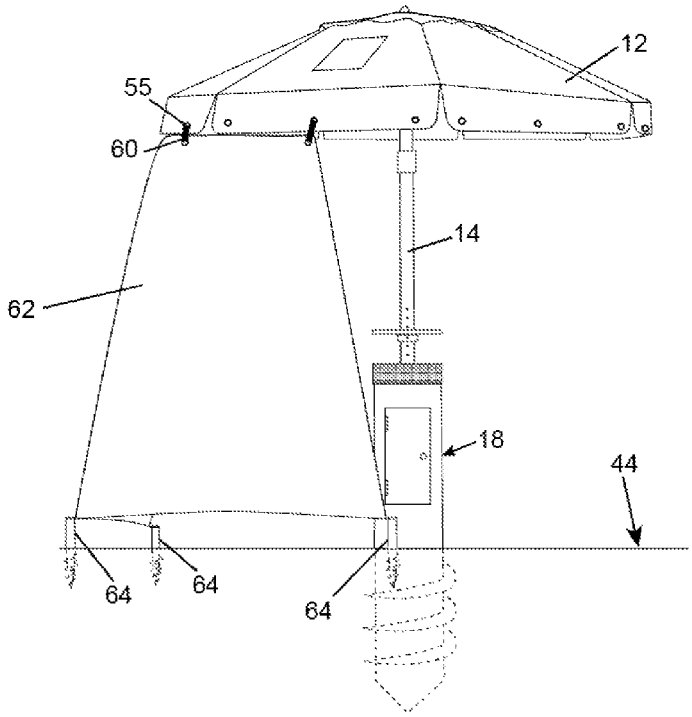
FIG. 3 shows a perspective view of an umbrella storage spike with an enhanced shade.

The subject device and method of use is sometimes referred to as the device, the invention, the umbrella, the storage spike, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes in its several iterations: a canopy 12, a pole 14, a cap assembly 16, an upper assembly 18, a lower assembly 20, a joint 22, a hinge 24, a door 26, a latch 28, a tray 30, detents 32, a flange 34, a body 36, a body 38, threads 40, a tip 42, a ground 44, a joint 46, a panel 48, a speaker 50, a charging port 52, a pocket 54, a grommet 55, a base 56, a drink holder 58, a clip 60, a shade 62 and a stake 64.

Other prior art umbrella designs include a canopy 12 and a pole 14. The present umbrella storage spike further includes a ground penetrating attachment and storage device generally comprised of an upper assembly 18 and a lower assembly 20.

The lower assembly 20 includes threads 40 on its exterior surface that assist a user of the spike to twist the lower assembly 20 into the ground 44 to securely support the upper assembly 18 and other components of the device. The threads 40 encircle the body 38 of lower assembly 20 from near the tip 42 and spiral upward towards the upper end of the lower assembly 20 near the joint 22.

By rotating the lower assembly 20 and pressing it into the ground 44, the lower assembly 20 will be able to anchor the device into a wide variety of soil types and conditions. Reversing the rotation of the lower assembly 20, it is essentially unscrewed from the ground 44 for relocation to erection at another place.

The lower assembly 20 has a generally hollow interior dimensioned to store inside personal items such as a wallet, a phone, car keys and other such items. The joint 22 connects the upper assembly 18 to the lower assembly 20. The joint 22 acts to seal the upper end of the lower assembly 20 and also to protect the contents inside the lower assembly 20. The joint 22 may essentially be a cap that seals the upper end of the lower assembly 20 to protect the interior from incursion of soil, water or other contaminants.

The joint 22 is removable by the user to access the interior of the lower assembly 20. In at least one version of the device, the nature of the joint 22 being removable from the lower assembly 20 is not obvious to a casual observer or thief so that the existence of the lower assembly 20 and its hollow interior container is hidden in plain sight, providing a degree of security by concealment. The joint 22 may be friction fit, threaded, clipped or otherwise connected to the upper assembly 18 on one side and the lower assembly 20 on the other side.

The joint 22 may include an access door or simply be open in the middle to allow access to the contents of the lower assembly 20 through the joint 22. Access to the interior of the body 38 may be made through the door 26 in the upper assembly 26 by reaching through the joint 22 into the body 38. The joint 22 may include a false bottom panel so anyone reaching into the upper assembly 18 may not see the means to get into the lower assembly 20 further adding to the security of the contents of the lower assembly 20 by concealment.

The body 38 of the lower assembly 20 may be insulated to preserve the temperature of its contents. Ice and beverages can be placed into the body 38 instead of the user transporting a separate cooler along with their umbrella device.

Similarly, the upper assembly 18 may also be insulated to allow convenient storage of cool drinks or food in the body 36. If the upper assembly 18 is used as a cooler, then the joint 22 could be water tight to prevent liquid, such as ice melt, from penetrating the body 38. The door 26 may also be insulated.

When the device is in use the lower assembly 20 is inserted into the ground 44 at least partially below grade. The upper assembly 18 remains above ground 44. The interior of the body 36 is generally hollow and dimensioned to contain personal items typically brought to the beach or a picnic.

Access to the interior of the body 36 is achieved most readily through the door 26. The door 26 may have hinges 24 along an edge to keep the door 26 attached to the body 36 and still permit easy access. An optional latch 28 is available with or without a locking mechanism. The latch 28 may be mechanical or may include a magnet to stick the door 26 closed in order to prevent instruction of soil, moisture and the unauthorized user of the device.

The cap assembly 16 covers the top edge of the body 36 to seal out the elements and keep the contents of the upper assembly 18 suitably secure. A speaker 50 may be affixed on or near the cap assembly 16. The speaker 50 may be connectable to a portable electronic device, such as a phone or music player, either wired through the charging port 52 or wirelessly. The speaker 50 may also include a powered amplifier to sufficiently power the speaker 50 enough to be enjoyed in a variety of conditions such as wind or to overcome the ambient noise of the location where the umbrella is used.

The cap assembly 16 may also include a charging port 52 that can recharge portable electronic devices, such as a phone. The charging port 52 may be connected to a battery that is part of the upper assembly 18 or cap assembly 16. The battery may be pre-charged before using the umbrella. Optionally, a photovoltaic panel 48 may be provided to supply power to recharge the battery or to directly supply power to the charging port 52. The charging port 52 may be a type that accepts a charging cable to connect the device to be charged or it could manifest as an induction charger so no wires would be necessary to connect the battery depleted device during the charging process.

On an upper side of the cap assembly 16 is a flange 34 adapted to connect to the bottom end of the pole 14. The flange 34 connection to the pole 14 may be friction fit, threaded, clipped or permanently affixed, as long as it can structurally keep the cap assembly 16 connected to the pole 14 during typical operation.

The pole 14 connects the canopy 12 to the upper assembly 18 through the cap assembly 16. The pole 14 may be adjustable in height if constructed of concentric tubes with spring button detents 32. A tray 30 is optionally provided along the length of the pole 14 to hold personal items or beverages.

An optional joint 46 is provided along the length of the pole 14 that permits the canopy to tilt relative to pole 14 to optimize the direction and shape of the shade provided by the canopy 12. The joint 46 may also allow the separation of the pole 14 to facilitate easier transportation and storage of the device. The pole 14 is preferably constructed of a rigid and durable material such as plastic, metal, fiberglass or other material structurally capable to carry the load of the umbrella during normal use, including wind gusts.

Around the peripheral underside of the canopy 12 may optionally be one or more pockets 54. The pockets 54 will provide additional storage space for personal items out of sight and some protection from the harsh environment that might be found at the beach or other location where the umbrella is used.

Also, around the periphery of the canopy 12 may be a series of grommets 55 or other style of connection points. To provide additional shade, privacy or wind protection, a shade 62 at an upper edge may be connected to the grommets 55 with a clip 60 or other commonly available connection means like a snap, tie or other connector. At a lower edge the shade 62 may be affixed to the ground 44 with a stake 64. Similarly, the shade 62 could span between grommets 55 on adjacent canopies 12 from two or more umbrellas instead of one end of the shade 62 connecting to the ground.

Both the canopy 12 and the shade 62 may be made of a flexible material that provides the requisite sun protection factor or degree of opacity. Fabrics, plastics and other such sheet material can be effective for these elements.

For some applications and use of the device on harder or compacted ground 44 the lower assembly 20 and threads 40 will be unable to penetrate the ground 44 to anchor the device. Similarly, in some protected areas it will not be permissible to disturb the ground 44 with a penetration. For example, when using the umbrella on a manicured lawn, a hole might not be possible. Similarly, if used on asphalt during a tail gating session, the device must entirely remain above grade.

In these situations the lower assembly 20 may be substituted for a non-ground-penetrating base 56. The base 56 will ideally have sufficient mass and width to support the canopy 12 in a variety of expected environmental conditions. The base 56 may include one or more drink holders 58 to hold drinks.

In at least one version of the device, the base 56 is hollow and can be filled with ballast when being set up. For example, filling the base 56 with sand or water may provide for sufficient weight to keep the umbrella upright. The base 56 can be removably connected to the upper assembly 18 at the joint 22 similar to when it is connected to the lower assembly 20 as described above.

A typical use of the umbrella storage spike may include first assembling the upper assembly 18 to the lower assembly 20. The joined upper and lower assemblies 18 and 22 are twisted to push the tip 42 into the ground 44. The threads 40 aid in twisting the lower assembly 20 into the ground. Once the upper and lower assemblies 18 and 20 are sufficiently engaged into the ground 44 to provide adequate support, the pole 14 and canopy 12 may be attached at the cap assembly 16. If desired, a shade 62 may also be deployed.

The upper and lower assemblies 18 and 20 are typically fabricated from a rigid and durable material such as metal or reinforced plastics. The diameter of the upper and lower assemblies 18 and 20 should be sufficient to allow for thick enough walls to retain rigidity and structural integrity but also to allow for ample storage inside. Typically a diameter of about ten to twelve inches is preferred. However, depending on the anticipated application of the device outside diameter of the upper and lower assemblies 18 and 20 could range between about four inches and eighteen inches.

The interior of either the upper assembly 18 or lower assembly 20 may include a shelf to partition the interior volumes and allow for distinct areas inside for organizing the contents. A false bottom on the upper assembly 18 may provide for more secretive access to the body 36 hidden in the lower assembly 20.

An important version of the invention can be fairly described as an umbrella storage spike comprised of, among other features, a lower assembly, an upper assembly, a cap assembly, a pole and a canopy. A bottom end of the lower assembly has a point with threads emanating upwards to aid in screwing the device into the earth. A joint connects an upper end the lower assembly to a lower end of the upper assembly thereby connecting the upper and lower assemblies. The cap assembly is affixed to a top side of the upper assembly and seals the top. The pole on a lower end is connected to the cap assembly and at an upper end supports the canopy. The lower assembly and upper assembly each have an open interior adapted to store personal items. The open interior of the lower assembly is insulated to act as a cooler. The joint includes an openable floor to allow access to the open interior of the lower assembly. A door is on a side of the upper assembly permitting access to the open interior of the upper assembly. The cap includes a speaker that is electronically connectable to a portable electronic device, for example a phone. The cap includes a charging port adapted to connect to and charge the portable electronic device. The upper assembly and lower assembly are generally cylindrical and each has an outside diameter of between six and fourteen inches. Optionally, a periphery of the canopy includes a plurality of grommets that connect to an edge of a shade and where an opposing edge of the shade is staked to a ground surface. Optionally, a periphery of the canopy on an interior side includes a pocket. Optionally, a photovoltaic panel is affixed to an upper surface of the canopy to supply power to the charging port. Optionally, the lower assembly 18 or the base 56 has an insulation layer on the inside to act as a cooler to keep cold drinks cool or keeps hot food hot. The layer might be made of polystyrene, neoprene or a low density synthetic material that is adhered to the interior of the lower assembly.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An umbrella storage spike comprised of a lower assembly, an upper assembly, a cap assembly, a pole and a canopy;

a bottom end of the lower assembly has a point with threads emanating upwards;

a joint connects an upper end the lower assembly to a lower end of the upper assembly;

the cap assembly is affixed to a top side of the upper assembly;

the pole on a lower end is connected to the cap assembly and at an upper end supports the canopy;

the lower assembly and upper assembly each have an open interior;

the open interior of the lower assembly is insulated;

the joint includes an openable floor to allow access to the open interior of the lower assembly;

a door is on a side of the upper assembly permitting access to the open interior of the upper assembly;

the cap includes a speaker that is electronically connectable to a portable electronic device;

the cap includes a charging port adapted to connect to and charge the portable electronic device;

the upper assembly and lower assembly are generally cylindrical and each has an outside diameter of between six and fourteen inches.

2. The umbrella storage spike in claim 1 further characterized in that a periphery of the canopy includes a plurality of grommets that connect to an edge of a shade and where an opposing edge of the shade is staked to a ground surface.

3. The umbrella storage spike in claim 1 further characterized in that a periphery of the canopy on an interior side includes a pocket.

4. The umbrella storage spike in claim 1 further characterized in that a photovoltaic panel is affixed to an upper surface of the canopy to supply power to the charging port.

5. The umbrella storage spike in claim 1 further characterized in that the open interior of the upper assembly is covered in insulation layer.

6. The umbrella storage spike in claim 1 further characterized in that an interior of a base is covered in insulation layer.

7. An umbrella storage spike comprised of a lower assembly, an upper assembly, a cap assembly, a pole and a canopy;

a bottom end of the lower assembly has a point with threads emanating upwards;

a joint connects an upper end the lower assembly to a lower end of the upper assembly;

the cap assembly is affixed to a top side of the upper assembly;

the pole on a lower end is connected to the cap assembly and at an upper end supports the canopy;

the lower assembly and upper assembly each have an open interior;

the open interior of the lower assembly is insulated;

the joint includes an openable floor to allow access to the open interior of the lower assembly;

a door is on a side of the upper assembly permitting access to the open interior of the upper assembly;

the cap includes a speaker that is electronically connectable to a portable electronic device;

the cap includes a charging port adapted to connect to and charge the portable electronic device;

the upper assembly and lower assembly are generally cylindrical and each have an outside diameter of between six and fourteen inches;

a periphery of the canopy includes a plurality of grommets that connect to an edge of a shade and where an opposing edge of the shade is staked to a ground surface;

a periphery of the canopy on an interior side includes a pocket;

a photovoltaic panel is affixed to an upper surface of the canopy to supply power to the charging port;

the open interior of the upper assembly is covered in insulation layer.

* * * * *